United States Patent [19]

Krasuski et al.

[11] Patent Number: 4,944,137

[45] Date of Patent: Jul. 31, 1990

[54] DEVICE FOR OPENING ENVELOPE BODIES, AND FOR FILLING THEM

[75] Inventors: Marek Krasuski, Fontenay Aux Roses; Bernard Prugnolle, Pantin, both of France

[73] Assignee: Societe Anonyme dite: Alcatel Satman, Bagneux, France

[21] Appl. No.: 380,343

[22] Filed: Jul. 17, 1989

[30] Foreign Application Priority Data

Jul. 27, 1988 [FR] France ..... 88 10122

[51] Int. Cl.[5] ..... B65B 43/26

[52] U.S. Cl. ..... 53/569; 53/266 A; 53/381 R

[58] Field of Search ..... 53/266 A, 569, 381 R, 53/387, 206, 460

[56] References Cited

U.S. PATENT DOCUMENTS 2,736,999 3/1956 Rouan et al. .
2,766,569 10/1956 Strother et al. ..... 53/569 X
2,835,090 5/1958 DeMaine .
2,914,895 12/1959 Martin .
4,205,506 6/1980 Moens et al. ..... 53/266 A X
4,337,609 7/1982 Foster et al. ..... 53/569

FOREIGN PATENT DOCUMENTS 3137033 4/1982 Fed. Rep. of Germany .

*Primary Examiner*—James F. Coan
*Attorney, Agent, or Firm*—Sughrue, Mion, Zinn, Macpeak & Seas

[57] ABSTRACT

A device for opening envelope bodies so that they can be filled has opening fingers coupled to actuator means for moving the fingers between a retracted position and an opening position in front of each envelope in a filling position. The device includes a preassembled assembly (30) formed on a "finger" shaft (35) which carries the fingers (30) which are mounted to rotate freely thereon and which are positioned longitudinally therealong and retained resiliently by abutment means, and secondly a guide plate (10) mounted relative to the assembly (30) to oppose the abutment means by constituting a sliding surface for the fingers when they are actuated. The device is applicable to processing mail.

16 Claims, 3 Drawing Sheets

DEVICE FOR OPENING ENVELOPE BODIES, AND FOR FILLING THEM

The present invention relates to machines for inserting mail into envelopes. Within such machines it relates more particularly to a device for opening the bodies of successive envelopes in order to insert mail into each envelope.

BACKGROUND OF THE INVENTION

In a machine for inserting mail into envelopes, it is conventional for envelope advance means to bring successive envelopes to be filled into a defined filling position and to present them facing a mail path. Each item of mail is advanced along its path and then inserted into the envelope then waiting in the filling position. After being filled, the envelope in question is ejected.

While an envelope is advancing towards its filling position, the envelope flap is unfolded. The envelope as put into its filling position has its flap held unfolded so as to avoid interferring with the operation of inserting mail into the envelope.

In order to facilitate this insertion operation, envelope body opening fingers which are normally retracted ahead of the envelope in its filling position are actuated to take up an opening position in which they penetrate partially into the envelope body in order to open it prior to an item of mail being inserted therein.

These fingers are generally mounted at the end of an actuator arm which is controlled synchronously with the running of an insertion cycle in order to retract the finger and in order to put them into the opening position.

It is often not easy to mount such opening fingers and their control mechanism given the small amount of room which is made available for them since the overall side of the insertion machine should be kept as small as possible.

The object of the present invention is to provide a device for opening the body of an envelope to be filled, which device is very simple in design and is very easy to mount in an insertion machine, while nevertheless taking up very little room together with its control mechanism.

SUMMARY OF THE INVENTION

The present invention provides a device for opening envelope bodies for filling, the device being for use in an insertion machine in which each envelope to be filled is held in a filling position facing a mail path, said device including opening fingers coupled to actuator means themselves coupled to control means in order to move the opening fingers between a retracted position and an opening position facing an envelope in said filling position, wherein the device includes a preassembled assembly formed on a finger shaft, with said opening fingers being mounted to rotate freely on said finger shaft, and with said finger shaft being fitted with longitudinal positioning first means for each finger, and with resilient abutment second means extending on the same side of said finger shaft for each finger, and wherein the device further includes a guide plate mounted facing said assembly and opposing the action of said second means on the fingers and guiding the fingers against one of its faces.

Said guide plate may be a plate coupling said mail path to the envelope when in the filling position in said insertion machine, said guide plate partially overlying said assembly.

Said finger shaft may further include at least one shoe sliding beneath said guide plate in order to maintain the orientation of said finger shaft.

Said finger shaft may further carry two longitudinal slideways in which it slides, and which enable the said assembly to be directly mounted in the insertion machine.

Advantageously, two rings and a spiral spring position each opening finger longitudinally on the finger shaft and one of the end lengths of the spring extends laterally facing the corresponding opening finger and has its tip folded beneath the finger in order to retain it.

BRIEF DESCRIPTION OF THE DRAWINGS

An embodiment of the invention is described by way of example with reference to the accompanying drawings, in which.

DETAILED DESCRIPTION

Figure 1:
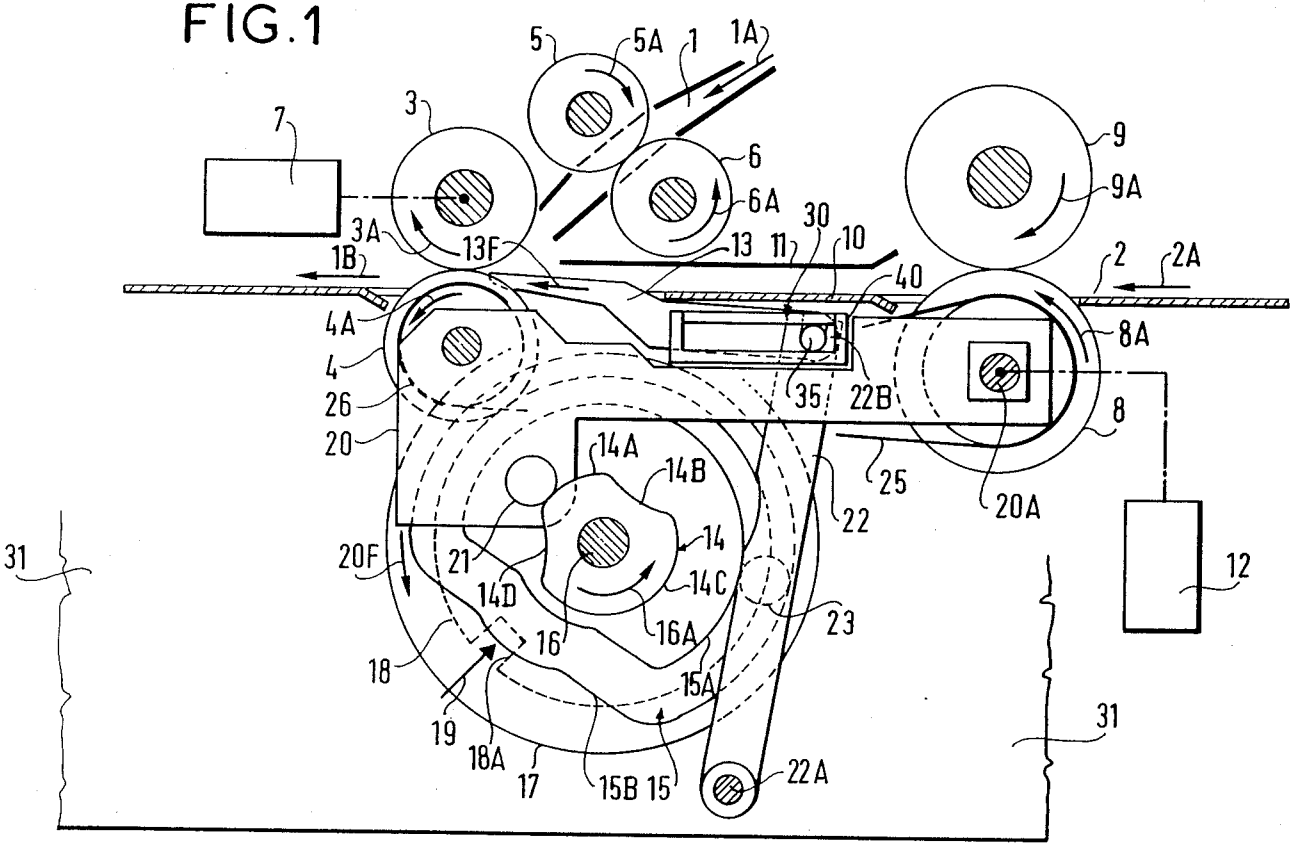
FIG. 1 is a fragmentary diagrammatic view in elevation showing an insertion machine fitted with a device in accordance with the invention for opening envelope bodies.

FIG. 1 shows the overall organization of an envelope filling station in an insertion machine fitted with an envelope body opening device in accordance with the present invention.

In FIG. 1, reference 1 designates a path for empty envelopes to be filled, and reference 2 designates a mail path. Arrow 1A shows the advance direction along the path 1 of an empty envelope to be filled, to be presented and maintained in a defined filling position facing the mail path 2. Arrow 2A illustrates the advance direction of an item of mail along the path 2 for transfer towards an envelope waiting to be filled, and for insertion into the envelope.

A first set of wheels 3 and an associated first set of backing wheels 4 contribute to advancing each envelope up to its filling position and to holding it in this position while it is being filled. A pair of second sets of wheels 5 and 6 pressing against each other slightly upstream on the path 1 serve to hold the previously unfolded envelope flap while the envelope is in its filling position. Appropriate means (not shown) serve to unfold the envelope flap while the envelope is advancing along the path 1. An envelope motor 7 is used for advancing each envelope. The motor is coupled, in particular to the first set of wheels 3 which it drives in the direction of arrow 3A, and it stops when the envelope is in the filling position.

The filling position corresponds to the envelope body passing between the first sets of wheels and backing wheels 3 and 4 so that the join line between the envelope body and its unfolded flap lies between the first sets of wheels and backing wheels 3 and 4.

A pair of third sets of wheels 8 and 9 contribute to advancing each item of mail along the path 2 for insertion into an envelope waiting to be filled. These sets of wheels 8 and 9 are resilently mounted to press against each other at the outlet from the path 2.

They face the sets of wheels 3 and backing wheels 4 at a distance from them which is less than the length of the mail to be inserted in the envelope. They thus suffice for ensuring that each item of mail is transferred to between the first sets of wheels 3 and backing wheels 4 and is inserted at least in part into the waiting envelope.

The mail guide plate 10 is mounted between the sets of wheels 8 and backing wheels 4. A backing plate 11 is associated therewith between the sets of wheels 9 and 3.

A mail motor 12 advances the mail along the path 2. It is shown coupled to the set of wheels 8 mounted beneath the outlet from the path 2. It could equally well be coupled to the set of wheels 9. Arrow 8A shows the direction in which drive is imparted to the set of wheels 8 by the motor 12 when switched on.

Envelope body opening fingers 13 are mounted between the sets of wheels 3 and backing wheels 4 and the sets of wheels 8 and 9. They are normally retracted in front of the sets of wheels and backing wheels 3 and 4. They are actuated along the direction of arrow 13F to a position in which they open the body of an envelope waiting in its filling position. Such a general disposition is known per se. The structure of the opening device of the invention which includes the fingers 13 is described in greater detail below.

In order to insert the fingers 13 into the envelope body and in order to insert the mail into the envelope held wide open in this way, the first set of backing wheels 4 is retractably mounted beneath the first set of wheels 3.

A cam 14 is used for controlling the first set of backing wheels 4 to take up a position in which they press against the first set of wheels 3 and to take up a retracted position. Another cam 15 is used for controlling the opening fingers 13 to take up their retracted position and to take up their opening position. These two cams 14 and 15 are mounted on a common drive shaft 16. Arrow 16A shows the driving direction of the drive shaft 16. It is driven by a control motor (not shown). The two cams 14 and 15 are initially set relative to each other so that the commands they issue take place synchronously with the various stages of an insertion cycle.

A pair of arms 20 carries the set of backing wheels 4. It is hinged about an axis 20A which is constituted by the shaft on which the mail advance set of wheels 8 is mounted. These arms carry a cam follower wheel 21 for following the cam 14. The wheel 21 is pressed against the cam 14 by resilient means, not shown. Arrow 20F shows the pivoting of the pair of arms 20 for putting the set of backing wheels 4 into the retracted position.

Another pair of arms or levers 22 carries the opening fingers 13. These levers are hinged about an axis 22A at their ends opposite to the opening fingers. These levers carry a cam follower wheel 23 running along the cam 15.

As shown, the cam 14 has two profiles 14A and 14C on its periphery which are centered substantially opposite each other and which serve to cause the set of backing wheels 4 to take up its presser position. It also has two other profiles 14B and 14D on opposite sides between the first two profiles and serving to move the set of backing wheels 4 into the retracted position. The cam 15 has only two profiles 15A and 15B around its periphery, one for causing the fingers 13 to take up the retracted position and the other for causing them to take up the opening position.

A disk 18 having a notch 18A is mounted together with the cams 14 and 15 on the drive shaft 16. It is associated with a detector represented by 19 mounted as an optical emitter-and-receiver "fork" disposed astride the disk 18 in order to detect the notch 18A. This assembly comprising the disk 18 and the detector 19 thus serves to detect a reference position of the shaft carrying the cams 14 and 15.

The set of backing wheels 4 is also coupled to the set of mail advance wheels 8 to be driven together therewith. They are coupled by a transmission belt 25 which is drawn only in part in order to avoid overcrowding the figure. For this purpose, the set of backing wheels 4 is mounted on a freewheel mechanism 26. An arrow 4A shows the direction in which rotary drive is imparted to the set of backing wheels 4, either by friction against the set of wheels 3 when driven, or else by the coupling provided with the set of mail advance wheels 8.

The implementation of the finger opening device of the invention is described in greater detail below with reference to FIG. 1 and more particularly with reference to FIGS. 2 and 3, with FIGS. 2 and 3 being diagrammatic plan views showing separately a pre-assembled opening finger assembly and the above-mentioned guide plate 10, said plate co-operating with said assembly and together therewith constituting the opening device.

The set of opening fingers is given an overall reference 30. It is mounted directly between two side plates of the machine such as 31, and it is held thereon and partially overlapped by the guide plate 10 which is positioned relative to said assembly and which is also fixed to the side plate.

The opening finger assembly 30 is described with reference to FIG. 2. References designating items thereof which are visible in FIG. 1 are the same as those used in FIG. 1. The assembly 30 is made up on a shaft 35 referred to as the "finger" shaft. It is arranged in a manner which is symmetrical about a plane intersecting the finger shaft halfway along.

It comprises two short opening fingers 13A on the end portions of the shaft and two intermediate long fingers 13B. The four fingers 13A and 13B are mounted to rotate freely on the finger shaft 35. These fingers are positioned longitudinally along the shaft 35 between respective pairs of rings 36 and 37. The two positioning rings of each finger are disposed further apart than the width of the corresponding finger. On one side of each finger there is a spring 38 wound around the finger shaft 35 between said finger and one of the corresponding rings, in this case the ring 37. In conjunction with the two rings, this spring serves to position each finger longitudinally. One of the ends of the spring is locked in the ring 37 by appropriate retaining means, not shown. The other end extends forwardly relative to the shaft along one of the sides of the corresponding finger, and the tip 38A thereof is folded beneath the finger, thereby forming a resilient abutment for the finger.

The ends of the finger shaft 35 are mounted in respective longitudinal slideways 40. Two spring clips 41 each disposed at the outside end of the corresponding slideway serve to retain these slideways on the finger shaft 35. In the assembly 30, taken as being not mounted between the two side plates of the inserting machine in FIG. 1, it is these slideways 40 which slide freely over the ends of the finger shaft 35. On the outside of each spring clip, there is a terminal ring 42 at the end of the shaft.

The finger shaft 35 also carries a central shoe 45. The shoe is in the form of a small rectangular section slab whose plane and rectangular top face constitutes a sliding surface for the assembly 30, which surfaces faces a reference path, and in particular the above-mentioned guide plate 10. The slab is held in position by a screw 46 or the like on the finger shaft and is not free to rotate relative thereto. It constitutes a shoe for orienting the finger shaft 35.

Figure 2:
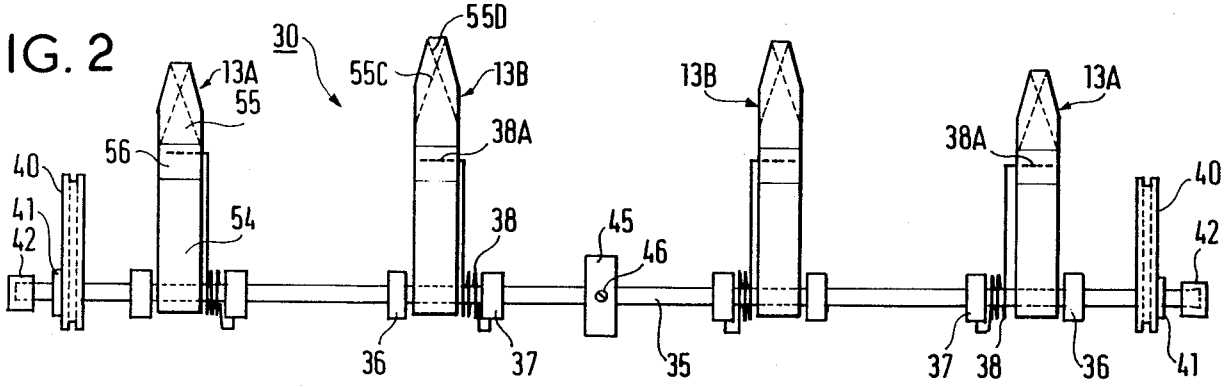
FIG. 2 is a diagrammatic plan view of an assembly belonging to the opening device of the invention.
Figure 3:
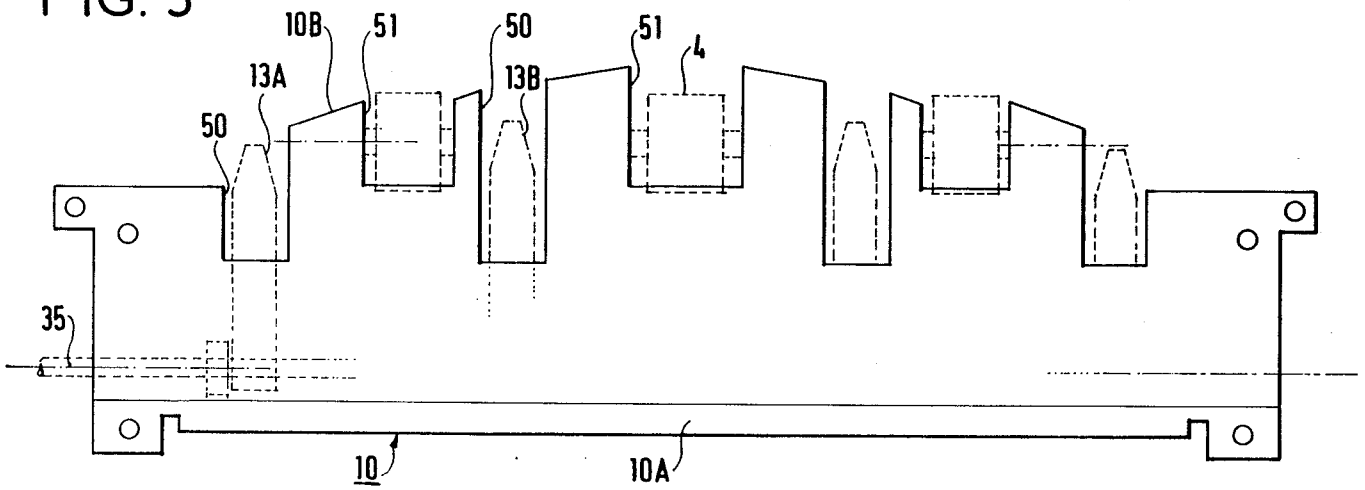
FIG. 3 is a diagrammatic plan view of another element co-operating, in particular, with said FIG. 2 assembly in an opening device of the invention.

FIG. 3 shows the above-mentioned guide plate 10 which co-operates with the assembly 30 of FIG. 2. The plate 10 is mounted like the assembly 30 between the side plates such as 31 of the machine (FIG. 1), and it partially overlies the assembly 30. In FIG. 3, the above-mentioned shaft 35 and the opening fingers 13A and 13B of the assembly as shown in FIGS. 1 and 2, and also the backing wheels 4 as shown in FIG. 1 can all be seen. The plate is plane, apart from its rear margin 10A which is folded slightly upwards.

Figure 4:
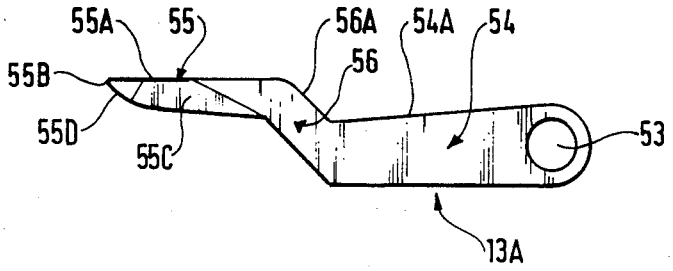
FIG. 4 is a profile view on a larger scale of one of the elements in the FIG. 2 assembly.

The front portion of this guide plate 10 has four notches 50 for the four opening fingers 13A, 13B of the assembly 30, which fingers are shown in dashed lines. The end portion of each finger lies flush with the plate in the corresponding notch. This same front portion of the guide plate 10 also has three other notches 51 which are shallower than the notches 50 and situated in the gaps between the notches 50. These notches 51 correspond to the above-mentioned first set of backing wheels 4 (FIG. 4). Each of the three backing wheels 4 in this first set projects slightly above the level of the guide plate through a corresponding one of the notches 51 when this first set of backing wheels 4 is in the pressor position.

In addition, the middle portion of the front edge 10B of the plate projects further forwards than the side portions. Its profile is that of a wide open upsidedown V-shape, with each of the arms of the V-shape being intersected by the notches 50 and 51.

The shape of the opening fingers 13 is described with reference to FIG. 2 and FIG. 4, with FIG. 4 being a side view on a larger scale of the short fingers 13A shown in FIG. 2.

The long fingers 13B are practically identical to the short fingers 13A except for their end portions which are slightly longer. They are therefore neither drawn nor described separately.

Each of the opening fingers 13A is constituted by an elongate shape. It has a terminal bore 53 passing through the elongate shape in order to mount it free to rotate on the finger shaft. The diameter of this bore is very slightly greater than the diameter of the finger shaft.

The shape has two main portions 54 and 55 which are joined by a small middle transition portion 56. The portion 54 is the portion having the bore 53. The portion 55 is the terminal portion of the finger in question when mounted on the finger shaft. The top faces 54A and 55A of both portions are substantially horizontal but the level of face 55A is slightly raised relative to that of face 54A. The top face 56A of the intermediate middle portion constitutes an inclined link slope.

The bottom faces of these portions 54, 55, and 56 are substantially parallel to the respective top faces thereof and are not referenced individually. Only the tip of the finger, on its portion 55 has a rounded bottom face 55D. This tip is referenced 55B and it forms a sharp angle leading to a portion or reduced thickness in order to facilitate finger insertion into an envelope, after which it increases in size in order to open the envelope properly.

With reference to FIG. 2 and/or FIG. 4, it can be seen that the figners 13A and 13B also have lateral chamfers 55C on their terminal portions 55 causing the bottom face of each terminal portion to be narrower than its top face. In addition, they have a rounded slope 55D on the bottom face of each tip 55B.

When the assembly 30 and the plate 10 are mounted in the machine, the top face 54A of the portion 54 of each finger constitutes the abutment plane of that finger against the bottom face of the guide plate 10 against the action exerted by the spring 38 associated with the finger. It also forms a guide plane for each finger beneath the plate 10 for guiding the fingers when they are actuated to move between their retracted position and their opening position, and back again. In addition, when the fingers are actuated into the opening position, the face 55A engages progressively into the corresponding notch 50, thereby accentuating the effect of the spring 38 and pivoting the leading portion 55 of each finger slightly upwardly.

The bottom sloping face of the intermediate portion 56 is received on the thrust end 38A of the spring. It therefore opposes any major sliding of the thrust end 38A of the spring.

When the opening fingers are being moved from one of their positions to the other, the central shoe 45 slides beneath the guide plate 10. This prevents the finger shaft 35 from rotating about its own axis.

Figure 5A:
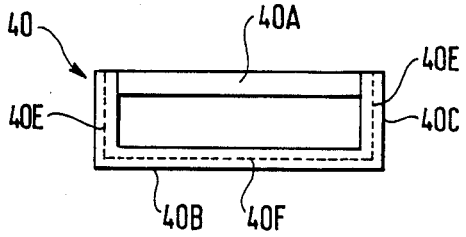
FIG. 5 represents another element, referred to as a slideway, of the FIG. 2 assembly, with said element being shown likewise on a larger scale and in front view in FIG. 5A and in plan view in FIG. 5B.
Figure 5B:
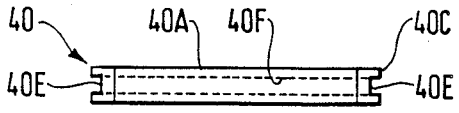

FIG. 5 shows one of the slideways 40 of the above-described assembly 30, as a front view in FIG. 5A and as a plan view in FIG. 5B. This slideway 40 constitutes a rectangular window in which the finger shaft is held while being allowed to slide. The slideway guides the finger shaft 35 when the assembly 30 is put into place on the machine. It also enables the assembly 30 to be mounted on the insertion machine (FIG. 1).

Each slideway 40 has a top long side 40A, a bottom long side 40B, and two identical ends 40C. It has a groove 40E running along each of its ends and another groove 40F running along its bottom long side 40B, only.

Although not shown in FIG. 1, it will readily be understood that a housing is provided in each side plate 31 for the corresponding slideway 40. This housing is open at its top. Each of its other three edges constitutes or presents a rib which is received in the corresponding groove of the slideway 40.

The assembly 30 which has its various components preassembled on the finger shaft 35 is thus equipped to be directly mounted very simply on the machine.

While the assembly 30 is being mounted on the machine, it can also be seen in FIG. 1 that it couples directly with its pair of control levers 22. To this end, as shown in FIG. 1, each of the levers 22 is constituted by an arm hinged at the bottom of the machine with its opposite ends to its hinge being in the form of a fork 22B which directly receives the end portions of the finger shaft 35.

The finger shaft 35 is retained in the forks 22B by the guide plate 10. The guide plate 10 also closes the top edge of each of the housings in the side plates 31 for receiving the slideways 40, thereby preventing the slideways from escaping.

Each of the control levers extends over the outside face of the corresponding side plate 31 of the machine. The outside face of each of these levers facing away from the side plate carries a short cylindrical projecting finger which constitutes the above-mentioned cam follower 23. The cam follower 23 is engaged in a path constituted by the cam 15. The path of the cam 15 is thus defined in the front face of a control disk 17 which faces the corresponding side plate 31 of the machine. The cam 14 for controlling the first set of backing wheels 4 is then constituted by the periphery of a hub on the control disk 17. This disposition makes it possible to provide both cams 14 and 15 on a single part 17.

The opening device of the invention is thus easy to manufacture, easy to assemble in an insertion machine, and easy to remove therefrom. It needs no subsequent adjustment. It occupies very little space, since it is disposed beneath the guide plate 10. The guide plate 10 then serves both to guide mail over its top face, coupling the mail path to the envelope in the filling position, and also to guide the opening fingers 13 and to keep the orientation of their shaft 35 constant in the assembly 30. In addition, the assembly 30 has very low inertia.

The present invention is described above with reference to the embodiment shown in the drawings. Naturally, detail modifications could be made thereto and/or various means could be replaced by equivalent other means without going beyond the scope of the invention. In particular, the resilient abutment means of the fingers constituted by spiral springs having one length constituting said abutments could be constituted by any other means preventing the fingers from rotating fully on the finger shaft and opposing the action of the plate 10 on said fingers. The slideways 40 carried by the finger shaft 35 of the assembly 30 prior to being mounted in the machine could be held laterally on the guide plate instead of being held on the side plates of the machine, in which case the guide plate and the assembly 30 can be assembled to each other prior to being fixed together on the machine.

Also, the function of maintaining the orientation of the finger shaft as provided by the central shoe 45 could alternatively be provided (either additionally or in a variant) by the terminal portions of the finger shaft. This can be done by giving a rectangular cross-section to these terminal portions as received in the slideways or else by forming flats thereon. In a variant, the longitudinal holding rings 36 and 37 could also perform this function of maintaining the orientation of the finger shaft 35.

We claim:

1. In a device for opening envelope bodies for filling for use in an insertion machine constituting means defining a mail path and in which each envelope body to be filled is held in a filling position facing said mail path, said device including opening fingers coupled to actuator means and control means coupled to said actuator means in order to move the opening fingers between a retracted position and an opening position facing an envelope in said filling position, the improvement wherein the device includes a finger shaft extending across said mail path, a preassembled assembly formed on said finger shaft, said preassembled assembly including said opening fingers mounted to rotate freely on said finger shaft about said shaft axis, longitudinal positioning first means on opposite sides of each finger for longitudinally positioning said fingers on said shaft, resilient abutment second means extending on the same side of said finger shaft for each finger between said longitudinally positioning first means, and wherein said device further includes a guide plate mounted facing said assembly and opposing the action of said second means on said fingers biasing said fingers against one face of said guide plate and guiding the fingers against said one face.

2. An opening device according to claim 1, wherein said guide plate is a plate coupling said mail path to the envelope when in the filling position in said insertion machine, said guide plate partially overlying said assembly.

3. An opening device according to claim 2, wherein said finger shaft further includes at least one shoe slidable beneath said guide plate for maintaining orientation of said finger shaft.

4. An opening device according to claim 2, wherein said finger shaft further is carried within two longitudinal slideways in which it slides.

5. An opening device according to claim 4, wherein each of said slideways is fitted with retaining and mounting means for directly engaging said assembly on side supports of the insertion machine, said slideways being disposed the same distance apart along said finger shaft as the distance between said supports.

6. An opening device according to claim 5, wherein said retaining and mounting means include grooves on sides of each slideway co-operating with corresponding edges of a housing provided in each support.

7. An opening device according to claim 4, wherein said guide plate has one of its edges projecting towards the front of the opening fingers and having notches in which respective ones of the opening fingers lie flush.

8. An opening device according to claim 4, and in which said actuator means of said fingers are constituted by hinged levers and by cam control means including a first cam, wherein said levers have a fork at one end for receiving said finger shafts, thereby providing direct coupling therewith.

9. An opening device according to claim 8, wherein each lever carries a laterally projecting finger, and wherein said first cam is constituted by a cam path which receives said projecting finger and which is formed in the front face of a control disk.

10. An opening device according to claim 9, wherein said control disk also has a hub whose periphery defines a second cam for controlling the means for bringing each envelope into the loading position in the insertion machine and holding it there.

11. An opening device according to claim 2, wherein each opening finger has an elongate shape comprising a first terminal portion having a terminal bore for rotatably mounting the finger on the finger shaft, an opposite second terminal portion substantially parallel to the first and connected thereto by a small intermediate portion having sloping faces, the second portion being at a level which is higher than the level of the first portion.

12. An opening device according to claim 11, wherein one of the sloping faces of said intermediate portion constitutes the face of the finger against which said resilient abutment second means come into abutment.

13. An opening device according to claim 12, wherein a top face of said first portion of said elongate shaped finger constitutes a bearing and sliding surface for the finger against one face of the guide plate when the fingers are actuated to move from either of their two positions to the other position.

14. An opening device according to claim 12, wherein said longitudinal positioning first means for the fingers on the finger shaft include two lateral rings for each finger on respective sides thereof.

15. An opening device according to claim 14, wherein said longitudinal positioning first means for the fingers on said finger shaft comprises a spiral spring mounted for each finger between one of the two rings and the finger.

16. An opening device according to claim 15, wherein said resilient abutment second means for each finger includes one end length of said spring extending along one of the sides of the finger and having its tip folded beneath the finger and another terminal length of said spring anchored in retaining means carried by said finger shaft.

* * * * *